United States Patent [19]

Deland

[11] Patent Number: 4,534,484

[45] Date of Patent: Aug. 13, 1985

[54] WATER COOLER BOTTLE CLOSURE

[76] Inventor: Francois Deland, 250 Montigny, Mont St-Hilaire, Quebec, Canada, J3H 2L9

[21] Appl. No.: 428,396

[22] Filed: Sep. 29, 1982

[51] Int. Cl.[3] ..... B65D 41/28

[52] U.S. Cl. ..... 215/307; 215/316; 215/354

[58] Field of Search ..... 215/307, 316; 220/254

[56] References Cited

U.S. PATENT DOCUMENTS

| | | | |
|---|---|---|---|
| 306,950 | 10/1884 | Pettit | 215/307 |
| 660,435 | 10/1900 | Hilgenberg | 215/307 |
| 1,635,438 | 7/1927 | Schmid | 215/316 X |

FOREIGN PATENT DOCUMENTS

| | | | |
|---|---|---|---|
| 956316 | 4/1964 | United Kingdom | 220/254 |

*Primary Examiner*—Donald F. Norton

*Attorney, Agent, or Firm*—Schwartz, Jeffery, Schwaab, Mack, Blumenthal & Koch

[57] ABSTRACT

A water cooler bottle closure made of a closure cap adapted to fit over the neck of a water cooler bottle, which closure cap has an opening formed at its bottom. A flange projects around the periphery of the opening to define an inner chamber. A base is provided to close the opening so as to enable the formation of an ice plug in the inner chamber when the latter has been filled with water and subjected to freezing conditions. A water bottle filled with such a closure, after having removed its base, can be tilted over a water cooler and during that process no spill takes place. The plug of ice then slowly melts and water runs into the cooler in the usual manner.

6 Claims, 5 Drawing Figures

WATER COOLER BOTTLE CLOSURE

BACKGROUND OF INVENTION (a) Field of the Invention

This invention relates to a water cooler bottle closure. More particularly, the present invention is directed to a device of the kind which enables to mount a water bottle over a water cooler while preventing any escape of water from the bottle during the tilting operation. After the bottle has been placed over the water cooler, water starts to flow into the cooler to be available to anyone.

(b) Description of Prior Art

Modern civilization has brought the pollution of an important portion of the water supply, to the extent that drinkable water which is harmless and pleasant to the taste is getting rare. In many places, such as in industrial plants and offices, as well as in homes, it is common to see fresh spring water made available through the use of a water bottle mounted upside down over a water cooler, with the neck plunging into the top part of the cooler. The difficulty with such an arrangement is that the bottle which is often very heavy must first of all be uncorked, and then tilted 180° to be mounted over the cooler with the neck down. It is obvious that this is an operation which is tedious and which has to be executed with some speed, in order to prevent any spill of water. A system which would be ideal would block the water flow from the moment the water bottle is tilted until it is well settled over the water cooler.

To my knowledge there is not available any system which would be effective in arriving at a reasonable solution to the problem mentioned above. I am aware of U.S. Pat. No. 1,635,438 which relates to an ice cap. Although it could be used to refrigerate a bottle of milk during delivery, it could not safely be mounted on a water bottle to prevent water spill because it could not stay on the neck when tilting a water bottle.

SUMMARY OF INVENTION

In order to overcome the above disadvantages, I have provided a water cooler bottle closure comprising a closure cap adapted to fit over the neck of a water cooler bottle, the closure cap having an opening formed at the bottom thereof, flange means projecting around the periphery of the opening, the flange means defining an inner chamber which is associated with the closure cap, and a base to close the inner chamber so as to enable the formation of an ice plug in the inner chamber when the inner chamber has been filled with water and the water has been subjected to freezing conditions.

In accordance with a preferred embodiment of the invention the opening is circular and the inner chamber is cylindrical.

In accordance with yet another embodiment of the invention the flange means comprises a circular wall which projects around the circular opening from the bottom of the closure cap, so that the cylindrical inner chamber lies entirely inside the closure cap.

In accordance with yet another embodiment of the invention the circular wall is interiorly corrugated so as to prevent the plug of ice from slipping outside the inner chamber.

In accordance with yet another embodiment of the invention, the base comprises means to enable it to fit snugly into the opening.

In accordance with still another embodiment of the invention the base is made of resilient material and comprises a disc portion having outwardly tapered walls which enable the base to fit snugly and imperviously into the opening and a handle portion integral with the base and enabling to insert the base into the opening previous to filling the inner chamber with water, and to remove the base from the opening before tilting over the bottle when mounting the same on the water cooler.

BRIEF DESCRIPTION OF DRAWINGS

The invention is illustrated by means of the following drawings in which.

DESCRIPTION OF PREFERRED EMBODIMENTS

Figure 1:
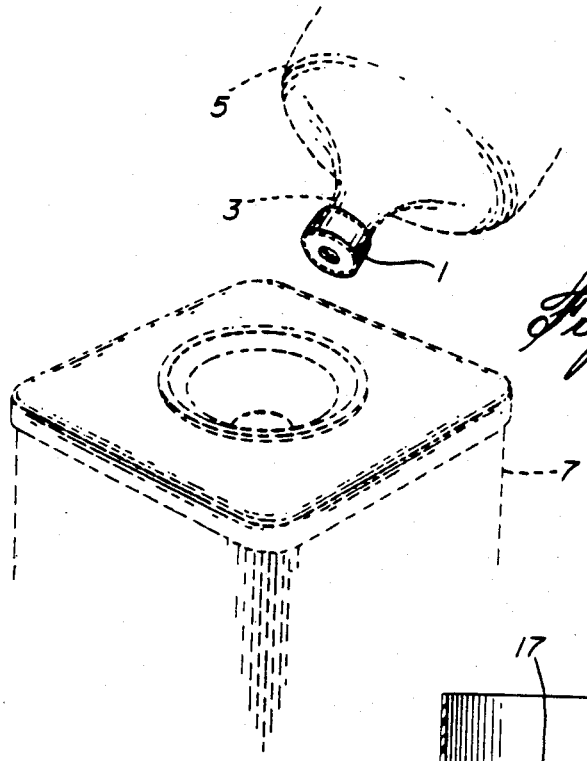
FIG. 1 is a perspective view of a water cooler and water bottle, fitted with a closure cap according to the invention, being placed over the water cooler.
Figure 2:
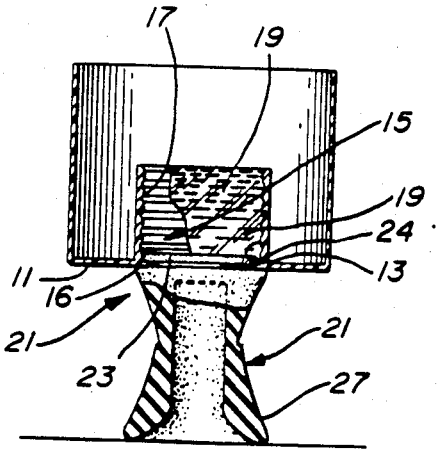
FIG. 2 is a cross-section view of a closure cap according to the invention.
Figure 3:
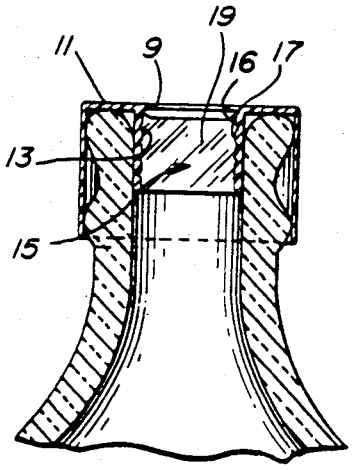
FIG. 3 is a cross-section view of the same closure cap mounted over a water bottle.
Figure 4:
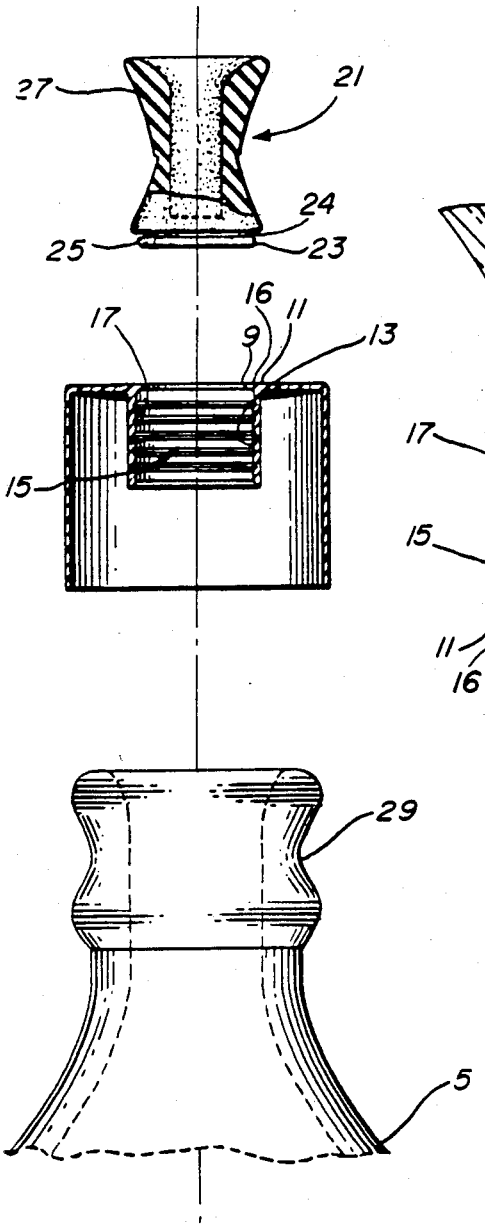
FIG. 4 is an exploded view showing the various parts of the closure cap illustrated in FIGS. 2 and 3, as well as a water bottle neck.
Figure 5:
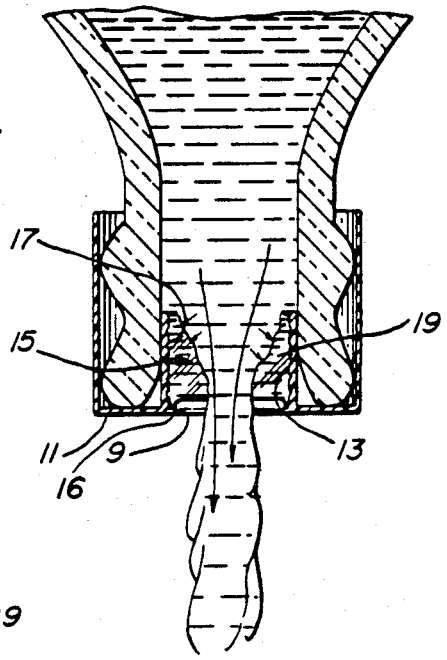
FIG. 5 is a view showing the melting of an ice plug formed in a device according to the invention.

Referring to the drawings, there is shown a closure cap 1 which is fitted over the neck 3 of a water bottle 5, the whole to be placed on a water cooler 7, as shown in FIG. 1 of the drawing. As illustrated in FIGS. 3, 4 and 5, the closure cap 1 has a circular opening 9 formed at its bottom 11. A circular wall 13 projects around the circular opening 9, in the manner shown in FIGS. 2 to 5, from the bottom 11 of the closure cap 1, to define an inner cylindrical chamber 15 which is integral with the closure cap 1. It will also be noted that the circular wall 13 is set back with respect to the opening 9 to define therewith a circular flange 16 as particularly shown in FIGS. 2–5. Also as shown, the inner cylindrical chamber 15 lies entirely inside the closure cap 1 and is adapted to fit inside the neck portion of the water bottle cooler. Of course, this is not essential and, as well known to those skilled in the art, the inner cylindrical chamber could be partly or entirely outside the closure cap 1.

The closure cap 1 described above can be made of any well known material. However, it is recommended to use a plastic material which can easily be molded. It has been found through experience that the closure cap 1 can more easily be fabricated by molding, and the particular technique involved is outside the scope of the present invention and is entirely left to those skilled in the art.

The inner cylindrical chamber 15 has corrugations 17 along the interior wall 13 thereof. The reason for providing these corrugations 17 along the interior wall 13 is to prevent the ice plug 19, which will be described below, from slipping outside the inner chamber 15 when handling the closure cap.

As another part of the device according to the invention, there is a base 21 which is preferably made of resilient material such as rubber. The base 21 comprises a disc portion 23 which has outwardly tapered walls 25. Between the disc portion 23 and the base 21, there is a circular channel 24. Because of the resilient nature of the material with which the base is made, the tapered walls 25 of the disc portion 23 will enable the disc portion to be press fitted into the opening 9 until the flange 16 is engaged by the circular channel 24, thereby enabling the disc portion 23 of the base 21 to fit snugly and imperviously into the opening 9 of the closure cap 1, all as shown in FIG. 2 of the drawings. The base 21 also has a handle 27 which is integral with the disc portion 23 and enables to insert the disc portion 23 into the opening 9. The handle 27 also permits to free the opening 9 before mounting the closure cap on the neck 3 of the bottle 5. The handle portion 27 can have any shape desired. In the model illustrated it appears as a truncated cone. However, one can elect the type of handle of his choice.

It will therefore be seen that when the water cooler bottle closure is not in use, the handle 27 should be mounted on the closure 1 by fitting the disc portion 23 in the circular opening 9 of the closure 1. Because of the tapered walls 25 of the disc portion 23, the handle 27 and the base 21 will be firmly held by the bottle closure 1. Then the chamber 15 is filled with water and the bottle closure 1 is placed in a freezer in the position shown in FIG. 2 of the drawings, where an ice plug 19 will be formed in the cylindrical chamber 15.

When a bottle of natural water 5 is intended to be mounted on a water cooler 7, the cap 29 of the water bottle 5 is removed and the bottle closure 1 with its base 21 is mounted over the neck 3 of the water bottle 5 in the manner shown in FIG. 5 of the drawings. The base 21 is thereafter removed and the bottle with its closure is tilted over and mounted on a water cooler.

As the ice melts, water starts to descend into the cooler until the bottle is empty.

After removing the water bottle from over the cooler, the bottle closure is removed from the neck of the water bottle, the base 21 is mounted in the circular opening, the inner chamber is filled with water and the assembly is placed in a freezer for further use.

I claim:

1. A water cooler bottle closure comprising:

a closure cap adapted to fit over the neck of a water cooler bottle, said closure cap having an opening formed at the bottom thereof, a continuous wall projecting around the periphery of said opening to define an inner chamber which is associated with said closure cap and is adapted to fit inside the neck portion of the water cooler bottle, said continuous wall being set back with respect to said opening to define a flange, a base including means engageable by said flange to imperviously close one end of said chamber so as to enable the formation of an ice plug in said inner chamber when said inner chamber has been filled with water and said water has been subjected to freezing conditions.

2. A water cooler bottle closure according to claim 1, wherein said opening is circular and said inner chamber is cylindrical.

3. A water cooler bottle closure according to claim 2, wherein said continuous wall is circular and projects around said circular opening from the bottom of said closure cap, so that said cylindrical inner chamber lies entirely inside said closure cap.

4. A water cooler bottle closure according to claim 3, wherein said circular wall is interiorly corrugated so as to prevent said plug of ice from slipping outside said inner chamber.

5. A water cooler bottle closure according to claim 1, wherein said base is made of resilient material and comprises a disc portion having outwardly tapered walls and a circular channel therebetween which enables the disc portion to be press fitted into said opening until said flange is engaged by said circular channel thereby enabling said disc portion to fit snugly and imperviously into said opening, and a handle portion integral with said base and enabling to insert said base into said opening previous to filling said inner chamber with water, and to remove said base from said opening before tilting over said bottle when mounting the same on said water cooler.

6. A water cooler bottle closure comprising a closure cap adapted to fit over the neck of a water cooler bottle, said closure cap having a circular opening formed at the bottom thereof, a circular wall which projects around said circular opening from the bottom of said closure cap to define an inner cylindrical chamber which is integral with said closure cap and lies entirely inside said closure cap, said circular wall being set back with respect to said opening to define a flange, said circular wall being interiorly corrugated, a base made of resilient material which comprises a disc portion having outwardly tapered walls and a circular channel therebetween which enables the disc portion to be press fitted into said opening until said flange is engaged by said circular channel thereby enabling said disc portion to fit snugly and imperviously into said opening, and a handle portion integral with the disc portion and enabling to insert said disc portion into said opening and to thereafter remove it from said opening, so constructed and arranged that when said water cooler bottle closure is not in use, said cylindrical chamber is filled with water and said water cooler bottle closure is placed in a freezer to form an ice plug in said cylindrical inner chamber, then when one intends to mount a bottle of water on said water cooler, said water cooler bottle closure is fitted over the neck of said bottle, said base is removed therefrom and said bottle provided with said closure is thereafter tilted and mounted on said water cooler.

* * * * *